United States Patent [19]

Kerber et al.

[11] Patent Number: 4,535,824

[45] Date of Patent: Aug. 20, 1985

[54] METHOD AND APPARATUS FOR THE MANUFACTURE OF WIRE LINK BANDS

[75] Inventors: Heinz Kerber, Weidenthal; Hella Kerber, Himberg 12, D-6731 Weidenthal/Pfalz, both of Fed. Rep. of Germany

[73] Assignee: Hella Kerber, Weidenthal, Fed. Rep. of Germany

[21] Appl. No.: 500,669

[22] Filed: Jun. 3, 1983

Related U.S. Application Data

[63] Continuation-in-part of Ser. No. 260,698, May 5, 1981, abandoned.

[51] Int. Cl.[3] ..... B21F 15/02

[52] U.S. Cl. ..... 140/111; 29/408; 29/766

[58] Field of Search ..... 140/111, 3 A, 3 R, 25, 140/84, 92.3, 92.4, 92.8, 92.94; 29/766, 408, 409, 410, 241, 235, 450, 267, 456, 464, 433, 468, 281.1, 281.4, 281.5; 72/142, 144; 59/12, 35; 254/108, 199, 233, 234; 24/205 R; 162/DIG. 1, 200, 273; 139/383 A; 198/848–850; 245/5

[56] References Cited

U.S. PATENT DOCUMENTS

| | | | |
|---|---|---|---|
| 2,613,433 | 10/1952 | Rojahn | 29/408 |
| 3,129,498 | 4/1964 | Runnels | 29/766 |
| 3,490,133 | 1/1970 | Glindmeyer et al. | 29/408 |
| 3,955,263 | 5/1976 | Gauthier | 29/766 |
| 4,477,959 | 10/1984 | Burnecke et al. | 140/92.5 |

FOREIGN PATENT DOCUMENTS

| | | | |
|---|---|---|---|
| 1002180 | 2/1957 | Fed. Rep. of Germany | 24/205 R |

*Primary Examiner*—Francis S. Husar
*Assistant Examiner*—Linda McLaughlin
*Attorney, Agent, or Firm*—Orville N. Greene; Frank L. Durr

[57] ABSTRACT

A method and apparatus for manufacturing wire link bands, for example for use in paper making machines, are disclosed. Several wire links or helices are arranged parallel to each other, adjacent helices having opposite pitch. The helices are simultaneously fed through a closure slot while under tension. The closure slot is so shaped as to cause each turn of each helix to be engaged between two adjacent turns of an adjacent helix, thereby to form a wire link band. The closure slot may be held stationery while the wire links are pulled therethrough, or the wire links may be held stationary under tension while the closure slot is moved along their length. A plurality of closure slots may be used to form several wire link bands in parallel, and at least one additional closure slot may then be used to combine the wire link bands into a larger wire link band or sieve. Connecting rods may also be inserted into the wire link bands and may be heat fixed before insertion.

19 Claims, 9 Drawing Figures

1b
1a
10
13
14
13;14
30
3
3a
3b
3c
1
1a
2
b
c
d

METHOD AND APPARATUS FOR THE MANUFACTURE OF WIRE LINK BANDS

BACKGROUND OF THE INVENTION

This application is a continuation-in-part of U.S. application Ser. No. 260,698 filed May 5, 1981 and now abandoned.

The present invention concerns a method and machine for manufacturing wire link bands, for instance of the type used in the manufacture of paper. It will be understood that the term "wire" used in this specification corresponds to the translation of the German word "Draht", i.e., to include monofilaments or small rods of wire-like forms whether made of metal or not. The invention pertains to wire link bands of the type described in Swiss Pat. No. 610,273. Such wire link bands are defined by a multiplicity of helical coils, wherein adjacent right and left wound coils are arranged by hand in interdigitated disposition and a respective connecting wire is threaded through the interdigitated turns of each pair of adjacent helices (coils). It is also possible to produce wire link bands without connecting wires when the helices have flattened bows on their turns as shown in FIG. 6 of the Swiss Pat. No. 610,273.

Before the helices are arranged in a wire link band they are closely wound having a pitch of approximately twice the diameter of the wire or preferably less. They are connected together in such a way that the turns of the first helix are pulled by hand to a pitch of about double the original pitch. Into these turns of the helix a second helix is pressed, also by hand, with sliding pressure, turn after turn, and the second helix becomes clamped between the turns of the first helix by virtue of a spring like tension in the individual helices. The third helix and all the following helices are joined in the same manner one after the other by hand to form a wire link band (as described in Swiss Pat. No. 610,273, page 4, second column, lines 37–51.) In the usual link bands, the spirals extend transversely of the band.

In order to produce a wire link band of high longitudinal strength it is necessary to insert connecting hinge wires into the interdigitated turns of adjacent helices.

It is difficult and requires manual dexterity to effect a uniform interengagement of all turns of the helices. Also the insertion by hand of the connecting wires one after the other is time consuming.

In the embodiment of the wire link bands shown in Swiss Pat. No. 610,273 in which the helices are connected by inserting wires therein, a connecting wire is pushed manually from one end of the helices into the space within the interdigitated portion of that pair of helices which includes the last added helix, after the addition of each new helix. If one of the turns of the last added helix has been inserted (i.e., interdigitated) much less deeply than the other turns thereof, i.e., if the turns are not uniformly aligned, a connecting wire cannot be inserted past the less deeply inserted turn. The likelihood of this problem occurring is increased by the initial contractive tension of the helices. In addition, once a helix has assumed an incorrect position, it cannot be pushed into the correct position by the connecting wire since the turns grip one another due to their contractile spring force and thus hold each other in fixed positions.

At least two persons are necessary to insert the connecting wires in the conventional manner. This is very time-consuming work and requires great accuracy and attentiveness, and furthermore it can be effected only for relatively narrow breadths (i.e. with only relatively short helices). For these reasons the inside diameter of the projecting arcs of the turns must conventionally be made larger or the diameter of the connecting wires must be made smaller than would otherwise be desirable, both of which expedients limit the life of the wire link band and the number of uses to which it can be applied. Furthermore, the diameter of the wire of the helix, as well as the pitch, cannot be made as small as would otherwise be desirable, which substantially limits the fineness that can be obtained. In paper machines, for example, this limitation is highly disadvantageous.

From the art of slide fasteners, or zippers, it is known that a pair of link chains, fixed by supporting tapes with a precise pitch spacing can be locked to each other by means of a movable slide. It is a fact of general experience that zippers cannot be closed when there is the slightest deviation from the proper pitch spacing, for instance as a result of shrinkage of the support tape. It is impossible, moreover, to close a zipper if the width between the link chains is too great.

SUMMARY OF THE INVENTION

The principal object of the invention is to eliminate the above-described disadvantages and to provide a simple method of manufacturing wire link bands economically by machine.

Another object of the invention is to provide a simple apparatus for carrying out the method of the invention.

According to the invention, these objects are achieved by causing three or more helices, arranged alongside of each other or one above the other, and converging toward each other, to pass through a common closure device having a narrow closure slot in which the turns of the individual helices are pressed precisely into each other in the manner of a slide fastener or zipper and are held together by the initial contractile stress, to form a wire link band, several of which can be joined in a similarly second joining operation to form a longer link band or sieve. Drive means is provided to pull the resultant wire link band through the closure slot while the latter is held stationary, or alternately to move the closure slot while the wire links are clamped in place.

The wire spirals employed in the process may be made of metal or synthetic material. Suitable synthetic materials include thermoplastic or thermosetting plastic materials. Suitable thermoplastic materials include cellulose esters such as cellulose acetate, polyamides such as nylon, polyesters, polyvinyl compounds etc. Suitable thermosetting plastics include plastics such as phenol-aldehyde, and urea-aldehyde, resins which have a thermoplastic stage of development before becoming thermoset and various commercially available resinous products which contain cross linking agents which on heating act to increase the resistance of the plastic to solvents, etc. Some thermoplastic ureas may have residual stresses or possess elastic memories resulting from a previous packaging or winding operation, such wires can be set or stabilized thermally to a straight form.

Usually it is desired to use connecting wires, and they are introduced into the corresponding openings of the interengaged or interdigitated turns of the helices of the link sieve as soon as the helices have left the closure slot (or the drive means if a stationary closure slot is used). How close the tips of the connecting wires are brought to the end of the closure slot depends on the shape and size of the helices and of the connecting wires. They assist in assuring the connecting of the helices as early (i.e. as near the closure slot) as possible. They can also be introduced with rotation around their central axis. During the introduction of the connecting wires, the helices are stretched in the direction of the source of the connecting wires when the mutual interlocking of the helices which is effected by their contractile nature is eliminated for a short time.

An apparatus according to the invention comprises a closure device (similar to the common closure device of a zipper) which has a closure slot with a construction having a cross sectional size at the outlet just sufficiently large that a plurality of helices can pass therethrough when interwoven or interdigitated. The height of the slot is approximately equal to the diameter of one helix which is to be passed therethrough but the width of the slot at the mouth or entrance and of the slot so defined by the side walls of the slot is enlarged so as to accommodate the several closely coiled helices before stretching and interweaving them. A closure device can also have a slot constructed to accommodate two or more link band sections of a length of several spirals.

In addition to the closure device the apparatus includes clamping means to grasp the formed link band section (of 3, 4 or more spirals) and drive means to move the closure device with respect to the grasping means. The closure section or device may be held stationary, in which case the drive means pulls the helices through the constriction, or movable, in which case the clamping means holds the helices stationary while the closure device is moved away from the clamping means by the drive means. In the case of a stationay closure means, the drive means may comprise one or more drive rollers that act on the helices to pull them through the closure slot with uniform tension and also serves to deliver the finishing connecting wire of the link band or link sieve.

In the case of a stationary closure device, after passing the drive means, the starting end of the link sieve is gripped by a transport head and pulled away from the closure device. By means of suitable centering devices, the transport head pushes the openings between the corresponding turns of each path of helices over stationary connecting wires. The connecting wires are held stationary during this operation by a single rolling pressure roller or a pair of pressure rollers or by a pressure roller line disposed in the transport head. The transport head is caused to move away from the exit opening of the closure slot at such a rate as to maintain or increase the tension on the wire link band, thereby providing the uniform stretching that is necessary for the insertion of the connecting wires. This movement of the transport head also serves to slide the helices onto the connecting wires. When the transport head has reached the intended width of link sieve (corresponding to a desired length of the helices) the link sieve is cut off on both side edges (at both ends of the helices). After the link sieve has been severed and removed from the delivery table, the transport head moves back toward the closure device carrying new connecting wires for manufacturing the next section of link sieve. This completes the manufacture of a link sieve and a new operation can now start.

In the case of a closure device that moves while the wire links or helices are held stationary, the drive means and helix storage container move simultaneously. The first turns of the wire link band, which is forced through the closure slot by the motion of the latter, are held in position by a suitable clamping device. A device for inserting the connecting wires, consisting of one or several belt drives with a suitable centering device, is arranged adjacent the locations of one or both side edges of the link sieve (i.e. one or both ends of the wire link band) as the latter emerges from the closure slot. The drive means also serves to power the connecting wire insertion device, and this insertion device is preferably arranged so that a single cycle, consisting of one forward and one backward movement of the closure device, suffices to remove the helices from the closure slot and to insert the connecting wires into the helices. A thermofixing device for heat fixing the connecting wires with respect to its straightness or resistance to solvents can be arranged relative to the insertion device to heat set the connecting wires before their insertion.

Individual link sieves can be connected together in accordance with the invention to form a longer link sieve by means of a plurality of closure slots located beside each other that produce wire link bands alongside of each other or stepwise alongside of each other, the adjoining turns of the helices of the several wire link bands being brought together in such a manner that they interengage and are connected in the same manner as the helices of a single wire link band. Alternatively, an additional helix or pair of helices or an additional link sieve can be introduced between each two link sieve or wire link bands to connect the adjoining turns thereof to form the desired longer link sieve. One advantageous arrangement for the lengthening of link sieves is to produce two link sieves side by side by means of stationary closure slots and, between them, to produce a third link sieve by means of a traversing closure slot, the turns of the two outermost helices of the third sieve then inserting themselves among the turns of the two other link sieves. This combination can be multiplied to produce a link sieve of any desired size.

The advance in the art resides in the fact that a large number of coils can be interconnected accurately in slide fastener fashion to form a link sieve in a surprisingly simple manner in one operation and that, at the same time, all the connecting wires necessary to connect the helices are introduced. As a result of the invention, machine manufacture of link sieves becomes possible and very fine link sieves of small slope and pitch, but nonetheless of large width and length, can be produced.

Another advantage is that the helices, due to being drawn through a narrow closure slot, automatically arrange themselves before introduction into the closure slot, so that no expensive feed and division apparatus is necessary despite the large number of helices that may be combined in this manner.

A further advantage of the invention is that the prefabricated helices can be produced without space between their turns, which simplifies their production, and that even differences in pitch or distortion within individual helices used as starting spirals for this invention do not hinder the process of assembling the link sieve or affect the quality of the product.

Another advantage is that the closure means can produce link sieves with varying pitches and with small displacements can connect different sizes of helices.

The stretching of the interlinked helices that is inherent in the process of the invention is advantageous in inserting connecting wires since the introduction of long connecting wires, which may reach a length of up to 10 meters in making broad sieves for paper machines, for example, is only possible when the intersecting spirals are stretched.

In the embodiment of a stationary closure means, link sieves are prefabricated as partial lengths which are then aligned and linked together subsequently, either in accordance with the conventional system or in accordance with the invention, to form a link sieve of greater length. The advantage of this method resides in the simplicity of the apparatus and the relative ease with which the connecting wires can be inserted. Furthermore, stock keeping and means for stocking the assembled spirals are simplified and made more convenient.

In the embodiment with a traversing closure means, each partial length produced can simultaneously be connected to the last helix of the previously produced link sieve section. By means of a suitable delivery device, the continuous manufacture of link sieves is thus made possible.

Other objects, advantages and features of the present invention will become apparent from the following description of the accompanying drawings.

Figures 1, 1A, 1B:
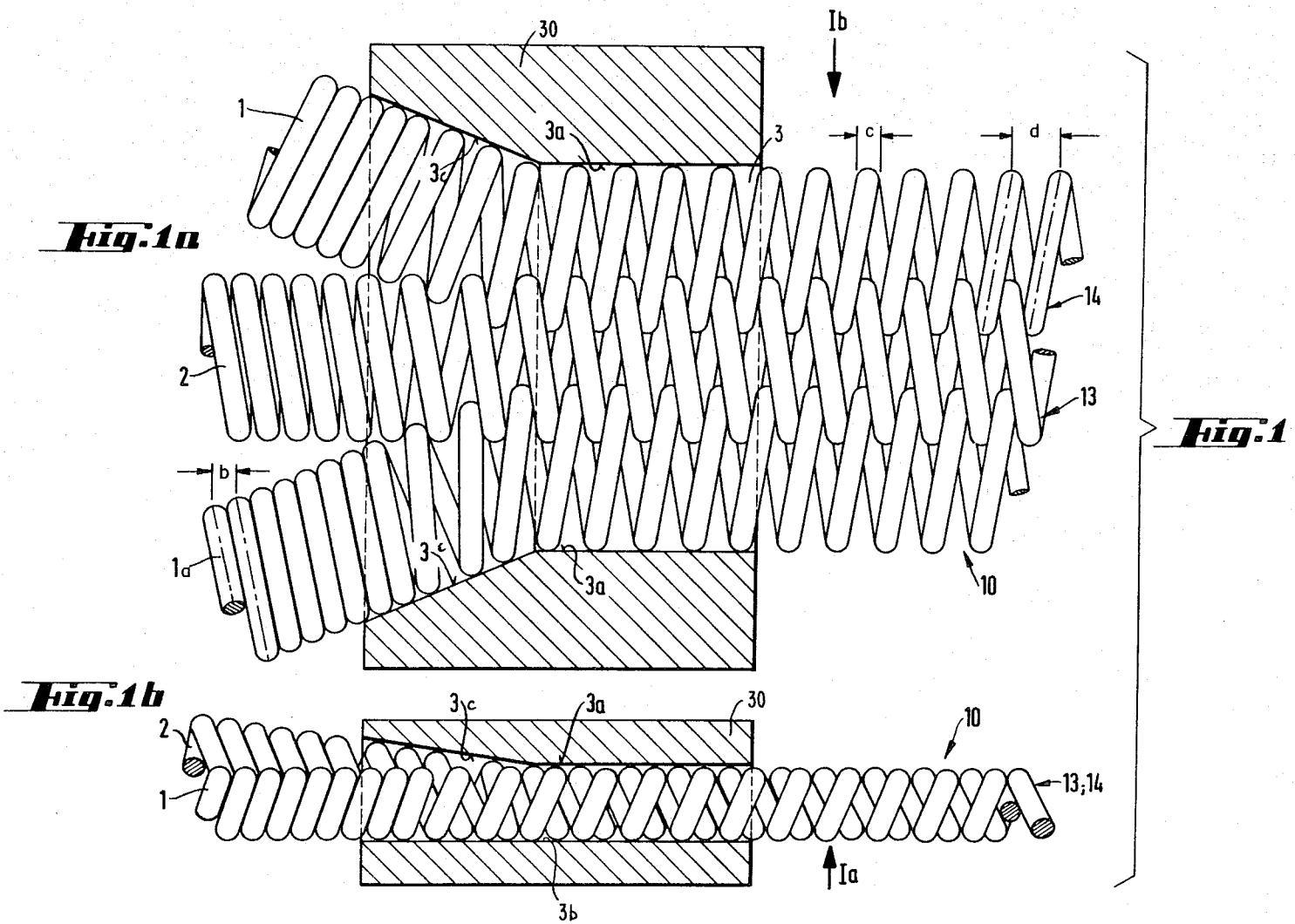
FIG. 1*a* is a transverse cross sectional view of a closure means for combining three helices according to the invention.
FIG. 1*b* is a cross sectional view taken at right angles to FIG. 1*a*.
FIG. 1 illustrates the method for producing wire link band sections 10, wherein three alternate right and left wound helical coils, 1, 2 1*a* are simultaneously pulled through a narrow closure slot 3 of closure slot means 30 (in direction of the arrow). The slot 3 comprises wedge-shaped side guiding wall section 3*c* and approximately even guiding wall section 3*a* and lower guiding wall section 3*b* (FIG. 1*b*). Before entering the closure slot 3 each helix 1, 2, 1*a*, has a pitch (b), smaller than twice its wire diameter (c) and the helices are arranged side by side, or partly side by side and partly one above the other, as seen in FIG. 1*b*. While passing through the closure slot 3 the pitch of the helices increases to a new pitch (d) of approximately twice the diameter of the wire. This is necessary so that the turns of the helices can interdigitate with the turns of their adjacent helix in zipper-like manner to form a section of a wire link band. By virtue of contractile spring force of the helices, the new pitch is regulated exactly. In order to better understand FIG. 1, there are only three helices illustrated, but it is possible to arrange 4, 5 or more alternately right and left wound helices for passing simultaneously through the closure means 30.

The guiding walls 3*a*, 3*b*, 3*c* of the closure slot cause the pressure on the helices to increase laterally, as shown in FIG. 1*a*, and from above and from the bottom, as shown in FIG. 1*b*, while passing through the closure slot. Simultaneously a tensile force is applied on each helix in the direction of the arrow, so that the helices are caused to stretch and change their pitch (b) elastically to the new pitch (d). It has been found that the combination of pressure and tension cause the helices to move together and interweave in zipper-like manner into interdigitated side by side relationship, forming a wire link band section 10 with tube-like openings 13, 14 between the helices 1,2,1*a*.

The guiding walls of the closure means 30 can have different wedge shapes, for instance, an arc of circle or ellipse. This depends on the helix material and the speed with which the helices 1, 2 etc. are to be passed through the closure slot. But it is important that the narrowest dimension of the tunnel shape of the closure slot is equal to the desired cross-sectional dimension of the wire link band which has to pass through it. It can happen that the tensil force applied by pulling is stronger than is necessary for extending the turns exactly to the pitch (d), so that, for a short time, the helices can have a pitch larger than the pitch (d). By virtue of contractile spring force of the helices they spring back exactly to the pitch (d) when released, clamping their corresponding turns together at the moment when they leave the drive means 4 (FIGS. 2–4) when the tensile force is no longer applied.

To prevent the helices so formed from being dislodged from their interdigital relationship in later use, connecting means comprising hinge wires 8 are inserted into the tube-like openings 13, 14. It is possible to use helices having connecting means in the shape of flattened bows in the turns of the zip fastener, as shown in Swiss Pat. No. 616,273, FIG. 6. In this case it is not necessary to use connecting wires for securing the interdigital relationship of the helices.

Incidentally, at "b" and "d" in FIG. 1, the way the pitch of a helix is measured from axis to axis of adjacent coils is illustrated: at b the pitch of the helix is equal to the diameter "c" of the wire of the helix, At "d" in the stretched helices the pitch is approximately equal to twice the diameter of the wire. The terms "interdigital" and "interwoven" are used in this specification to describe the condition of the combined helices as shown in the right hand part of FIG. 1*a*, for want of a better term.

Figure 2:
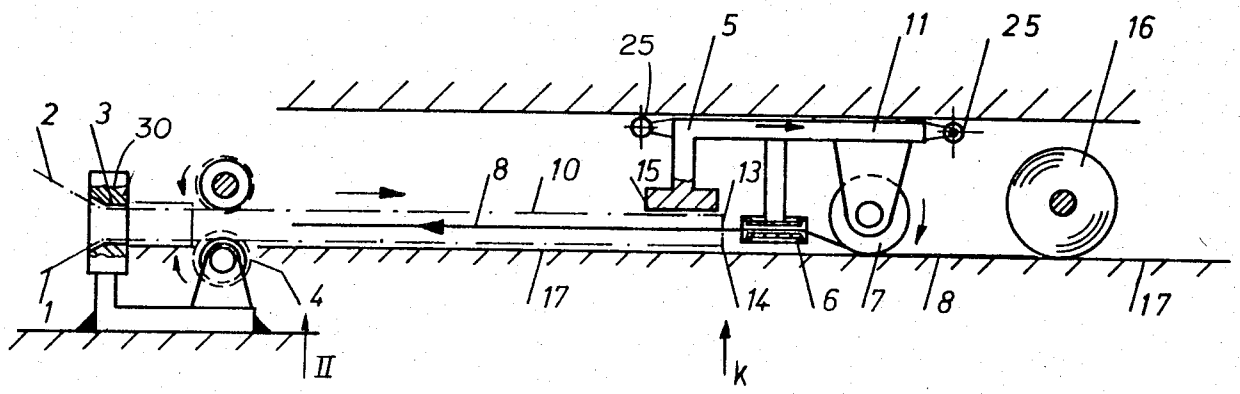
FIG. 2 diagrammatically shows a preferred embodiment in accordance with the invention of a stationary closure means combined with a traversing transport head.

FIG. 2 shows an arrangement wherein the closure means 30 is stationary; the helices 1, 2, etc. are pulled through the slots by drive means 4 and deposited on a delivery table 17, whereupon the combined group of spirals is clamped at D by the gripper 15 of the transport head 11 and guided along table 17 to a selected end position K. The transport head 11 is driven back and forth between D and K by separate drive means (not shown) or manually, for example. A suitable drive means for the transport means comprises a rack and gear means. The transport means comprises the clamping means 5, a gripper 15, a centering device 6 for the connecting wires 8 and a pressure roller 7 to prevent the connecting wires from moving with the transport head. At the starting end D, the wire link band 10 is seized by gripper 15 and transported away from drive means 4, while slipping the openings 13, 14 etc. over connecting wires 8 held stationary by roller 7. For better clarity only one connecting wire 8 is shown. The centering device 6 arranged next to the gripper 15, comprises a series of tube-like guiders so arranged side by side that their axes correspond, respectively, to the central points of the openings 13, 14 of the wire link band section. If the transport head moves at a higher speed than the speed of delivery of the wire link band from drive means 4, the link band is stretched longitudinally and the coils of adjacent spirals in the link band do not clamp each other so that the insertion of connecting wires is facilitated. After reaching the desired lateral dimension of the wire link band (e.g. position K) the band is cut off along with the connecting wires 8 at position D and the finished section D-K is removed. After opening gripper 15, the link band section springs back to its normal pitch and a new operation is started.

Figure 3:
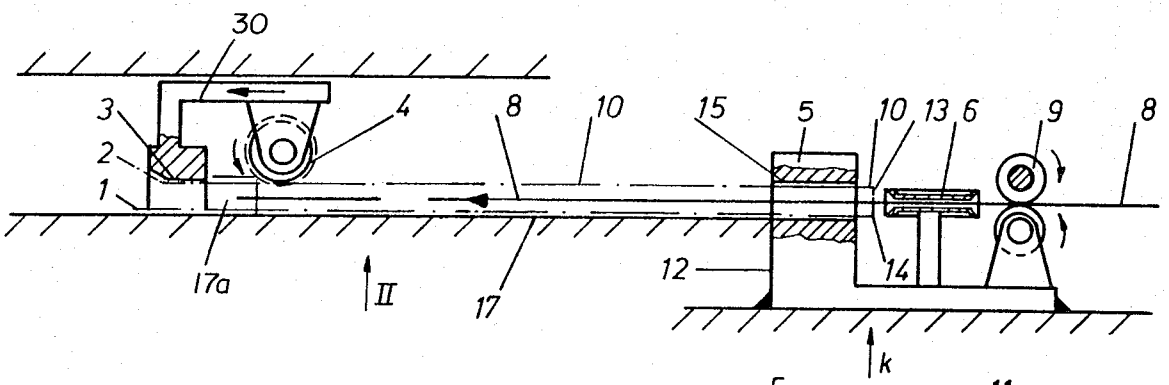
FIG. 3 diagrammatically shows a preferred embodiment in accordance with the invention of a traversing closure means combined with a stationary lateral insertion device for inserting connecting wires.

FIG. 3 illustrates an embodiment where the closure means 30 moves and the gripper 15 is stationary. The same elements have the same numerals as in FIG. 2. The closure means 30 and drive means 4 is constructed to move forward and backward along a line on table 17. The starting point for movement is at clamping device 5. The gripper 15 is opened and a short end of wire link band section 10 (only the first starting end is prepared by hand) is pulled through closure slot 30 and drive means 4 and fixed in gripper 15 which then holds the wire link band section in stationary position. The closure slot means 30 and drive means 4 is then propelled forwardly in the direction of the arrow thereon, away from gripper 15. The drive means 4 comprising one drive roller, rolls over the wire link band which is deposited on stationary table 17. The motion of the closure means 30 and drive means 4 pulls the helices 1, 2 and 1*a* (not shown) through closure slot 3 to form said wire link band section. The closure slot 3 is similar to that shown in FIG. 1*b* except that the bottom wall 3*b*, as shown in FIG. 1*b*, is formed by the table top 17 which remains stationary while the other walls of the closure slot move along the table. As soon as the point D has been passed, the section is cut at D, the length D-K is removed and the closure device 30 and drive means 4 returned by separate drive means (not shown) to gripper 15, transporting the end of the new section and the uncombined spirals 1,2 and 1*a* with it, where the protruding end from the end at D is again clamped in device 5.

In FIG. 3, a plurality of connecting wires 8 (only one shown) is inserted into the wire link band by the insertion means 6 and 9 of stationary device 12. The several wires 8 are pushed simultaneously by drive rollers 9 through centering devices 6, into the respective openings 13, 14 of the band section up to position D close to drive means 4. This insertion can be made while the closure slot means is moving or afterwards, and before or after cutting at "D". After cutting and removal of the section D-K the closure slot means 30 and drive means 4 is moved back to the starting position, manually or by separate transport means (not shown) and drive roller 4 is inactivated during the return motion. The storage means for the helices (not shown) is moved by separate drive means (not shown) corresponding to the movement of the closure slot means 30 and drive means 4.

Figure 4:
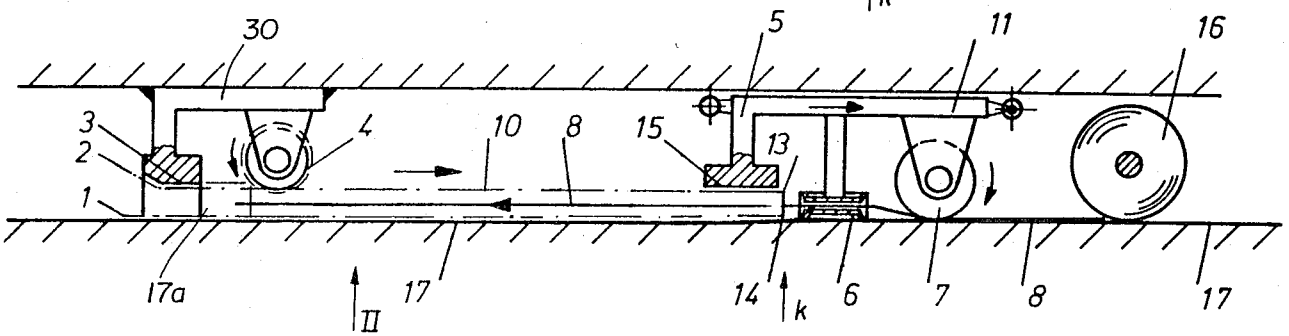
FIG. 4 diagrammatically shows another preferred embodiment according to the invention of a stationary closure means with a traversing transport head.

FIG. 4 shows a slight modification of FIG. 2, wherein the table top 17 becomes the bottom wall of the closure slot 3 and only one drive roll 4 feeds the link band section from the closure slot.

Figure 5:
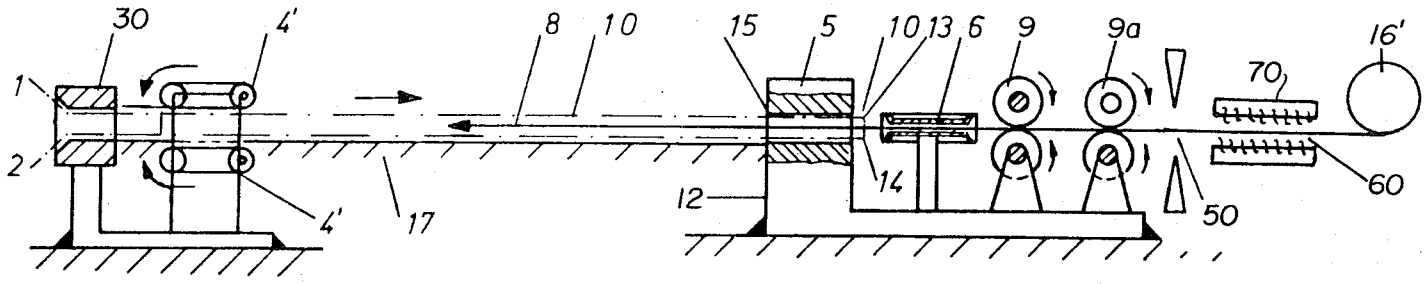
FIG. 5 diagrammatically shows another preferred embodiment of the invention, wherein a stationary closure slot section has a stationary means for inserting the binding wires and includes means to set the connecting wire.

In FIG. 5 the stationary closure slot means 30 operates with two belt pressure rollers 4' which pull the helices 1, 2 through the closure slot 3. A guiding means 17*a* as illustrated diagrammatically in FIG. 3 or 4 is necessary to guide the formed wire link band 10 between the exit end of closure slot 3 and the belt pressure rollers 4', because the pulled interlaced helices of the wire link band are stretched and the adjacent corresponding turns cannot clamp each other together. The belt pressure rollers 4' push the wire link band 10 along the delivery table 17. When the starting end of the wire link band 10 has reached the stationary insertion device 12, the gripper 15 is clamped to the wire link band 10, so that the connecting wires 8 can be inserted by two pairs of pressure rollers 7, 7*a* and centering device 6 into the corresponding openings 13, 14 of the wire link band 10. For better guiding the connecting wires, one or two pressure rollers can be grooved (not shown) according to the tunnels of the centering device 6. The gripper 15 can be elongated at its upper part in direction toward the closure slot section, so that the wire link band 10 is better clamped for the insertion operation (not shown).

If connecting wires 8 are of plastic material and require further setting to a straight condition by reason of incomplete cross linking or as a result of their elastic memory, a heat setting means 70 can be arranged in advance of inserting device 12. The connecting wires 8 are pulled from a braked bobbin 16' through a heating zone 60 and then through cooling zone 50 (e.g. air nozzles) so that they are straightened before reaching drive roller pairs 9 and 9*a*.

Figure 6:
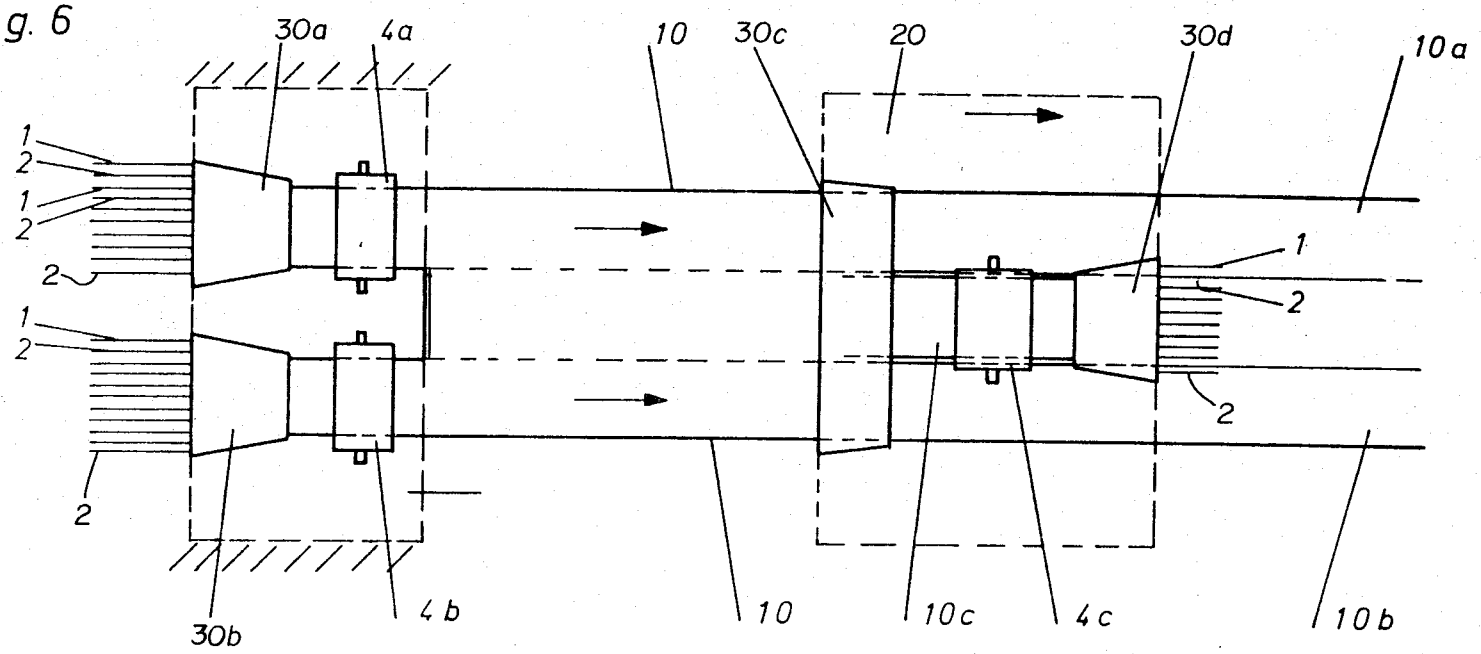
FIG. 6 diagrammatically shows an embodiment of the invention wherein two stationary closure slot means are combined with a movable closure slot means for joining link bands from the two stationary slot means.

In FIG. 6 a stationary closure slot section 19 consists essentially of two closure slots means 30*a* and 30*b*, two pressure rollers 4*a*, 4*b* and two guiding means (not shown) corresponding to 17*a* of FIG. 3 or 4. The pressure rollers 4*a*, 4*b* each pull ten helices 1,2 through the closure slot means 30*a*, 30*b* and feed the two wire link bands 10*a*, 10*b* so formed onto a delivery table (not shown). When the desired width of the wire link bands 10*a* and 10*b* is reached, a movable closure slot section 20 having closure slot means 30*d* starts near the closure slot section 19 and produces a third wire link band 10*c* between the wire link bands 10*a*, 10*b*. One additional closure slot means 30*c* joins the turns of the outermost helices 1, 2 of the wire link band 10*c* with the corresponding turns of the two other wire link bands 10*a*, 10*b* to forms a larger wire link band. If the movable closure slot section 20 is reversed so as to move in the opposite direction, it can start producing its wire link band from the opposite end of the two stationary closure slot means 30*a* and 30*b* of section 19 but can only start after the bands 10*a* and 10*b* have attained the desired length and after the movement of said bands 10*a* and 10*b* has stopped.

Figure 7:
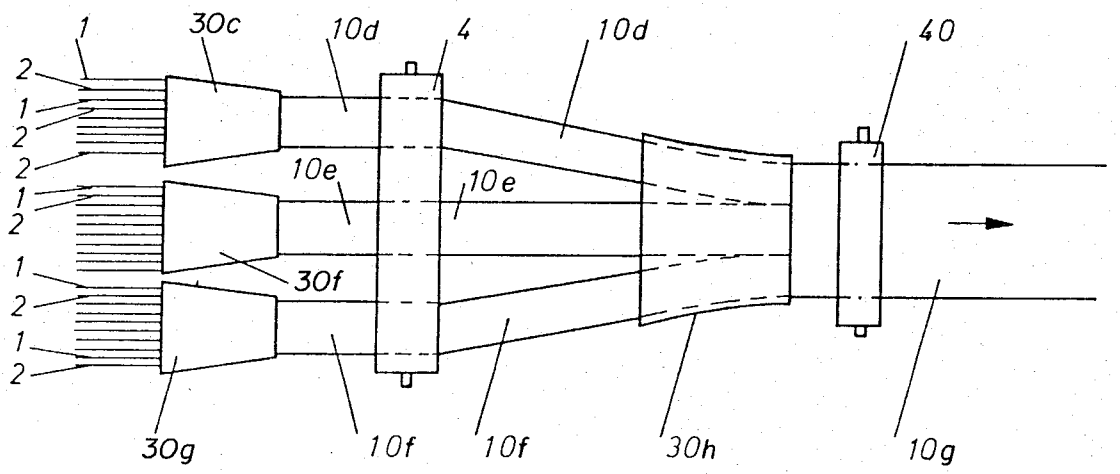
FIG. 7 diagrammatically shows an embodiment of the invention wherein the link bands from three stationary closure slot means are guided to a closure slot means for combining the three bands.

In FIG. 7 three stationary closure slot means 30*c*, 30*f*, 30*g* are combined with one pair of drive rollers 4, whereby simultaneously thirty helices 1,2 etc. are pulled through the closure slot means 30*c*, 30*f*, 30*g*. After passing the common drive means 4, the three wire link bands 10*d*, 10*e*, 10*f* are pushed onto a suitable delivery table (not shown) with suitable guiding means (not shown). A drive roll 40 pulls the wire link bands 10*d*, 10*c*, 10*f* through a further closure slot means 30*h*, which joins the three wire link bands with their corresponding turns of their helices of each wire link band to a larger wire link band 10*g*. Twenty-nine connecting wires can be simultaneously inserted into the larger wire link band 10*g* by a stationary wire insertion device (as shown at 11 in FIGS. 2 and 4). The insertion of connecting wire can also be arranged by a movable transport head (as shown in FIGS. 2 and 4, detail at 11).

Figure 8:
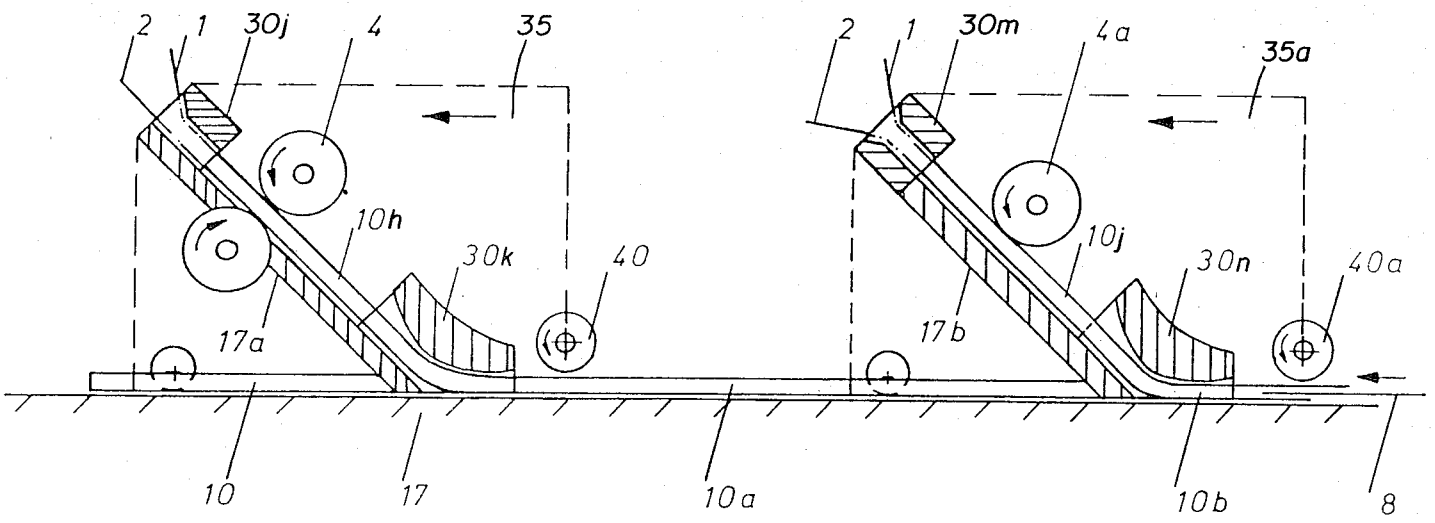
FIG. 8 diagrammatically shows an embodiment of the invention wherein two movable closure slot means are combined with an additional closure slot means for combining the two link bands.

In FIG. 8 two movable closure slot sections 35 and 35*a* are positioned stepwise along and over the delivery table 17. On the delivery table 17 a previously formed wire link band 10 is clamped. Along this wire link band 10 the first closure slot section 35 moves, producing a second wire link band 10*h* by means of closure slot means 30*j*, drive means 4 and guiding means 17*a*. By the moving of the closure slot section 35, produced by drive means 4, the helices 1,2 are pulled through the closure slot means 30*j*, forming a wire link band 10*h*, which then passes through an additional closure slot means 30 so that the edge helix thereof meshes with the edge helix of the clamped wire link band 10. The turns of the edge helices of both wire link bands 10, 10*h* are joined together to a larger wire link band 10+10*h*. The second closure slot section 35*a* moves simultaneously with the closure slot section 35 in the same way, but displaced by the amount of the length of the wire link band 10*h* (corresponding to the side to side width of the helices). The second closure slot section 35*a*, with the means of closure slot means 30*m*, guiding means 17*b* and transporting means 4*a* means 4, produces a third wire link band 10*j* and joins its turns with the corresponding turns of the wire link band 10, 10*h* by the constriction of the closure slot means 30*n* and roller 40*a*. After receiving the desired width (corresponding with the desired length of the helices) of the wire link band, connecting wires 8 can be inserted into the corresponding openings of the turns of the helices of both newly produced wire link bands 10*h*, 10*j*, and additionally the connection wire joining the wire link band 10 and the wire link band 10*h* can be inserted. This insertion can be made by means of insertion device shown at 12 in FIGS. 3 and 5. This insertion can also be made simultaneously during the production of the closure slot sections 35, 35*a*.

Before the insertion of the connecting wires, the two newly produced wire link bands 10*h*, 10*j* are cut off on the opposite side of the insertion device i.e., when they reach the left end of link band 10 as shown in FIG. 8. After the insertion of the connecting wires, they also are cut off on the side of the insertion device by mechanical or thermal means. The combined wire link band 10, 10*h*, 10*b* can be moved out of the operation position by suitable means and the two closure sections 35, 35*a* moved back to start another operation.

We claim:

1. A method for manufacturing link bands of wire-like monofilament material comprising the steps of:

providing a set of at least three helices comprising helically formed wire-like monofilaments of metal or synthetic material, wherein the pitch and diameter of the several helices are substantially equal and alternate ones of said helices are right-hand wound coils and the others are left-hand wound coils, the pitch of said helices being less than twice the diameter of the monofilaments of said helices, simultaneously pulling the set of helices through a narrow closure slot adapted to align the helices and exert resistance to the pulling tension thereon, whereby to open the pitch of the coils elastically and to press adjacent turns of the aligned helices toward each other to cause each turn of each wire helix to become interdigitated between the adjacent two turns of the adjacent helices, and thereafter releasing the tension on said coils to permit the interdigitated coils to grip one another.

2. The method of claim 1 comprising the additional step of inserting a plurality of wire-like connecting strands of metal or synthetic material, one into each pair of overlapping interdigitated segments of the coils of the set as the set has passed the narrow closure slot.

3. The method of claim 1 or 2, wherein the tension exerted on said set of helices is such that the pitch of the extended helices thereof is greater than twice the diameter of the wirelike monofilaments of which the helices are made.

4. The method of claims 2 comprising the step of further arranging and tensioning preformed band sets side by side and pressing the adjacent edge helices of said band sets together to cause them to engage each other to form a larger link band.

5. The method of claim 2, wherein the monofilaments are synthetic material and comprising heat treating the connecting strands to set the same before insertion in the link band.

6. The method of claim 1, wherein a plurality of such wire link bands are simultaneously formed by means of arranging, tensioning and moving steps, said moving steps being performed by means of each wire link band being moved through a respective closure slot simultaneously, and further comprising the step of pressing the so-formed wire link bands together to cause them to engage each other in the same manner as the individual wire helices of each individual wire band engage each other, to form a larger wire link band.

7. An apparatus for manufacturing wire-link bands from a set of at least three aligned, alternately right-hand and left-hand helices of metal or synthetic material and of substantially uniform diameter and each helix having a pitch of less than twice the diameter of the wire of the helices comprising closure slot means having a closure slot which has a lateral entrance opening with one dimension equal approximately to the sum of the overall diameters of the individual helices, the closure slot narrowing down from the entrance opening to an exit opening smaller than the sum of the diameters of the set of helices, whereby said helices must interengage or interdigitate to pass out of said exit opening, drive means adjacent the exit side of said closure slot means for moving the interengaged or interdigitated set of helices away from the exit of said slot and for applying sufficient tension to the helices to open the pitch of the helices and cause the adjacent helices to engage each other as the set of helices passes through said closure slot of the closure means.

8. The apparatus as claimed in claim 7, comprising gripping means to grip the interengaged and interdigitated set of helices coming from said drive means, said closure slot means being mounted to remain stationary and said gripping means being movably mounted to move away from said closure slot means.

9. The apparatus as claimed in claim 8 comprising inserting means for inserting straight connecting wires into the spaces between the overlapping portions of the interdigitated helices, said inserting means being connected to said movable gripping means.

10. The apparatus as claimed in claim 9, comprising a transport means which includes a means for holding at least one straight connecting wire steady in position to be threaded into the space between interdigitated parts of the wire link band as the transport means moves away from the closure slot means.

11. The apparatus as claimed in claim 10, wherein said means for holding the connecting wire in position for threading into the space between interdigitated parts of the wire link band comprises a centering guide between the gripping means and a pressure roller behind the centering guide.

12. The apparatus of claim 9 further comprising a heat fixing device for heat fixing the connecting wires before they are inserted into the wire link band.

13. The apparatus of claim 9 further comprising a plurality of such closure slot means for simultaneously forming a plurality of wire link bands and comprising at least one additional such closure slot means for causing the wire link bands so formed to engage each other in a similar manner to form a larger wire link band.

14. The apparatus of claim 9, wherein at least one said closure slot means is stationary and at least one said additional closure slot means is adapted to be moved generally parallel to the wire link bands it forms into a larger wire link band while the wire link bands being so combined are held stationary.

15. The apparatus as claimed in claim 8, wherein a movable closure slot section comprising at least one closure slot means is combined with at least one stationary closure slot section having at least one closure slot means and an additional closure slot means adapted to combine the wire link bands from the stationary and the movable closure slot means to form a larger wire link band.

16. The apparatus as claimed in claim 15 comprising insertion means for inserting connecting wires in said edge helices.

17. The apparatus as claimed in claim 7 comprising gripping means to grip the interengaged or interdigitated set of helices coming from said drive means, said gripping means being mounted to remain stationary and said closure slot means and drive means being mounted for movement away from said gripping means.

18. The apparatus as claimed in claim 17, comprising inserting means for inserting straight connecting wires into the spaces between overlapping portions of the interdigitated helices, said inserting means being mounted behind said stationary gripping means with respect to the closure slot means, and comprising means for feeding connecting wires in the spaces between the interdigitated helices.

19. The apparatus as claimed in claim 18 comprising a centering device between the inserting device and the gripping device for guiding the wires into said spaces between the interdigitated helices.

* * * * *

UNITED STATES PATENT AND TRADEMARK OFFICE

CERTIFICATE OF CORRECTION

PATENT NO. : 4,535,824

DATED : August 20, 1985

INVENTOR(S) : Heinz KERBER and Hella KERBER

It is certified that error appears in the above-identified patent and that said Letters Patent is hereby corrected as shown below:

On title page of U.S. Patent No. 4,535,824 please insert

-- [30] Foreign Application Priority Data

May 5, 1980 [DE] Fed. Rep. of Germany . . . . P 30 17 378 --

Signed and Sealed this

Eighteenth Day of August, 1992

*Attest:*

DOUGLAS B. COMER

*Attesting Officer*

*Acting Commissioner of Patents and Trademarks*